US008746843B2

(12) United States Patent
Ohashi et al.

(10) Patent No.: US 8,746,843 B2
(45) Date of Patent: Jun. 10, 2014

(54) RECORDING APPARATUS

(71) Applicant: Seiko Epson Corporation, Tokyo (JP)

(72) Inventors: Kazuyoshi Ohashi, Matsumoto (JP); Minoru Kishigami, Matsumoto (JP); Daisuke Tanaka, Shiojiri (JP); Shota Mizuno, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/622,909

(22) Filed: Sep. 19, 2012

(65) Prior Publication Data

US 2013/0070023 A1 Mar. 21, 2013

(30) Foreign Application Priority Data

Sep. 20, 2011 (JP) ..... 2011-204446

(51) Int. Cl.
*B41J 23/00* (2006.01)
*B41J 25/304* (2006.01)
*B41J 25/308* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 2006/0197801 | A1 | 9/2006 | Hashii et al. | |
| 2008/0304086 | A1 * | 12/2008 | Okazawa et al. | 358/1.5 |
| 2009/0309922 | A1 * | 12/2009 | Iwakura | 347/37 |
| 2010/0231643 | A1 * | 9/2010 | Saiga et al. | 347/37 |

FOREIGN PATENT DOCUMENTS

| | | |
|---|---|---|
| JP | 2004-017314 | 1/2004 |
| JP | 2006-096028 | 4/2006 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A recording apparatus includes a recording head and a carriage. The carriage includes a slide member that is provided so that the position of the slide member relative to a carriage body is changeable in a direction where a gap between the recording head and a medium changes, and moves together with carriage body in the scanning direction, a gap adjusting cam that is interposed between the slide member and the carriage body, and, upon reception of the dead weight of the carriage, changes in the scanning direction relative to the slide member and the carriage body to change the gap, and a restriction section that restricts at least one of expansion of the interval between the carriage body and the gap adjusting cam and expansion of the interval between the gap adjusting cam and the slide member in such a way as to keep a predetermined gap.

9 Claims, 10 Drawing Sheets

RECORDING APPARATUS

BACKGROUND

1. Technical Field

The present invention relates to a recording apparatus that performs recording on a medium.

2. Related Art

An ink jet printer as one example of a recording apparatus will be described hereinbelow by way of example. The ink jet printer includes a recording head mounted on a carriage to eject ink on a recording sheet or paper.

The carriage is configured such that the carriage is guided by a guide member extending in the scanning direction of the recording head (hereinafter referred to as "main scanning direction"), and is fixed to a part of, for example, an endless belt, whereby the traction of the endless belt causes the carriage to reciprocate in the main scanning direction.

Because the position of the carriage at which the endless belt is fixed cannot normally coincide with the position of the center of gravity of the carriage, the phenomenon that the carriage tends to rotate (called "swinging phenomenon") may occur when the carriage is in traction by the endless belt. This phenomenon lowers the ink landing precision. There are several swinging directions including swinging on an x-z plane and swinging on an x-y plane where y is the sheet transporting direction on the recording surface of a recording sheet, x is a direction (sheet's widthwise direction) orthogonal to the y direction, and z is a direction orthogonal to the recording surface.

JP-A-2006-96028 describes a recording apparatus configured to include an urging section which exerts urging force between a guide member (guide shaft) and a carriage, whereby rotational moment in a given direction is applied to the carriage beforehand so that the rotational moment in the given direction is always produced regardless of the moving direction of the carriage, thereby preventing swinging of the carriage.

JP-A-2004-17314 discloses an image forming apparatus configured in such a way that to suppress rattling between first and second guide members, provided along the moving direction of the carriage, and the carriage, an urging section presses the portions of the carriage which slide in contact with the guide members against the guide members.

Some ink jet printers are configured to be able to adjust the gap between the recording head and a sheet of paper (hereinafter referred to as "PG"), so that adjusting the PG can provide adequate recording results regardless of the thickness of the sheet.

Various mechanisms for adjusting the PG have been proposed. One of the adjusting mechanisms is configured to adjust the PG by changing the height position of the guide member that guides the carriage in the main scanning direction.

Let us consider a case where the PG adjusting mechanism is configured to adjust the PG by changing the relative position on the carriage between a slide member which slides in contact with the guide member, provided fixedly, and the carriage body. More specifically, the PG adjusting mechanism is configured in such a way that a gap adjusting cam to change the PG is provided between the slide member and the carriage body, and is displaced to adjust the position (height) of the carriage body relative to the slide member.

According to this configuration, part of the carriage is mounted on the gap adjusting cam, which is mounted on the slide member mounted on the guide member. However, only the dead weight of the carriage is applied between the carriage and the gap adjusting cam and between the gap adjusting cam and the slide member, so that the carriage may be lifted up from the gap adjusting cam or the gap adjusting cam may be lifted up from the slide member when the carriage is driven, causing swinging of the carriage. The aforementioned recording apparatuses according to the related art do not have such a gap adjusting structure, and are not naturally designed to cope with the aforementioned technical problem.

SUMMARY

An advantage of some aspects of the invention is to provide a gap adjusting mechanism interposed between a carriage and a slide member and configured to slide a gap adjusting cam to adjust a PG, thereby suppressing swinging of the carriage caused by lifting of the carriage from the gap adjusting cam or lifting of the gap adjusting cam from the slide member.

To bring about the advantage, according to a first aspect of the invention, there is provided a recording apparatus including a recording head that performs recording on a medium, and a carriage movable in a scanning direction of the recording head. The carriage includes a carriage body holding the recording head, a slide member that is provided in such a way that a position of the slide member relative to the carriage body is changeable in a direction where a gap between the recording head and the medium changes, and moves together with carriage body in the scanning direction, a gap adjusting cam that is interposed between the slide member and the carriage body to receive a dead weight of the carriage, and changes in the scanning direction relative to the slide member and the carriage body to change the gap, and a restriction section that restricts at least one of expansion of the interval between the carriage body and the gap adjusting cam and expansion of the interval between the gap adjusting cam and the slide member in such a way as to keep a predetermined gap.

According to a second aspect of the invention, in the recording apparatus according to the first aspect, the restriction section may have a shape extending in the scanning direction, and may change according to the gap to restrict at least one of expansion of the interval between the carriage body and the gap adjusting cam and expansion of the interval between the gap adjusting cam and the slide member in such a way as to keep the predetermined gap.

According to a third aspect of the invention, in the recording apparatus according to the first aspect, the gap adjusting cam may be configured to have a stepped cam surface with alternate arrangement of flat surfaces making a thickness of the gap adjusting cam uniform in the direction where the gap changes, and inclined surfaces causing the thickness of the gap adjusting cam to vary, whereby abutment of an abutting portion provided on the slide member or the carriage body on the stepped cam surface defines the gap, and the recording apparatus may include a control unit that controls a motor driving the carriage, and detects in which step the gap is by detecting a drive load of the motor when the abutting portion moves on the stepped cam surface.

According to a fourth aspect of the invention, in the recording apparatus according to the second aspect, the restriction section may be engaged with the carriage body at both end portions, and may be attached to the slide member at a center portion.

According to a fifth aspect of the invention, in the recording apparatus according to the fourth aspect, the gap adjusting cam may receive the dead weight of the carriage body at a plurality of positions in the scanning direction, and the restriction section may restrict the carriage body at a plurality of positions along the scanning direction, the plurality of positions for restricting the carriage body in the scanning direction being located on both sides of the positions where the gap adjusting cam receives the dead weight of the carriage body.

To bring about the advantage, according to a sixth aspect of the invention, there is provided a recording apparatus including a carriage provided with a recording head that performs recording on a medium, and is movable in a scanning direction the recording head, a slide member that constitutes the carriage, is provided in such a way that a position of the slide member relative to a body of the carriage is changeable in a direction where a gap between the recording head and the medium changes, and moves together with carriage in the scanning direction, a guide member extending in the scanning direction to receive a dead weight of the carriage, a gap adjusting cam that constitutes the carriage, is interposed between the slide member and the carriage body to receive the dead weight of the carriage, and changes in the scanning direction relative to the slide member and the carriage body to change the gap, and an urging section that constitutes the carriage and exerts urging force between the slide member and the body of the carriage in a direction of pulling the slide member and the body of the carriage.

According to the sixth aspect of the invention, the recording apparatus with the configuration to adjust a gap (PG) by displacing the gap adjusting cam interposed between the slide member which slides in contact with the guide member includes the urging section to exert urging force between the slide member and the carriage body in the direction of pulling the slide member and the carriage body. This makes it possible to suppress swinging of the carriage caused by lifting of the carriage body from the gap adjusting cam or lifting of the gap adjusting cam from the slide member, i.e., to suppress swinging of the carriage, when the carriage is driven, thereby providing favorable recording results.

According to a seventh aspect of the invention, there is provided a recording apparatus including a carriage provided with a recording head that performs recording on a medium, and is movable in a scanning direction the recording head, a slide member that constitutes the carriage, is provided in such a way that a position of the slide member relative to a body of the carriage is changeable in a direction where a gap between the recording head and the medium changes, and moves together with carriage in the scanning direction, a guide member extending in the scanning direction to receive a dead weight of the carriage, a gap adjusting cam that constitutes the carriage, is interposed between the slide member and the carriage body to receive the dead weight of the carriage, and changes in the scanning direction relative to the slide member and the carriage body to change the gap, and a pinching section that constitutes the carriage and pinches the gap adjusting cam between the slide member and the body of the carriage.

According to the seventh aspect of the invention, the recording apparatus with the configuration to adjust a gap (PG) by displacing the gap adjusting cam interposed between the slide member which slides in contact with the guide member includes the pinching section that pinches the gap adjusting cam between the slide member and the body of the carriage. This makes it possible to suppress swinging of the carriage caused by lifting of the carriage body from the gap adjusting cam or lifting of the gap adjusting cam from the slide member, i.e., to suppress swinging of the carriage, when the carriage is driven, thereby providing favorable recording results.

According to an eighth aspect of the invention, there is provided a recording apparatus including a carriage provided with a recording head that performs recording on a medium, and is movable in a scanning direction the recording head, a slide member that constitutes the carriage, is provided in such a way that a position of the slide member relative to a body of the carriage is changeable in a direction where a gap between the recording head and the medium changes, and moves together with carriage in the scanning direction, a guide member extending in the scanning direction to receive a dead weight of the carriage, a gap adjusting cam that constitutes the carriage, is interposed between the slide member and the carriage body to receive the dead weight of the carriage, and changes in the scanning direction relative to the slide member and the carriage body to change the gap, and a restriction section that constitutes the carriage and restricts at least one of expansion of the interval between the carriage body and the gap adjusting cam and expansion of the interval between the gap adjusting cam and the slide member.

According to the eighth aspect of the invention, the recording apparatus with the configuration to adjust a gap (PG) by displacing the gap adjusting cam interposed between the slide member which slides in contact with the guide member is configured to restrict at least one of expansion of the interval between the carriage body and the gap adjusting cam and expansion of the interval between the gap adjusting cam and the slide member. This makes it possible to suppress swinging of the carriage, thereby providing favorable recording results.

According to a ninth aspect of the invention, in the recording apparatus according to the sixth aspect, the gap adjusting cam may receive the dead weight of the carriage body at a plurality of positions in the scanning direction, and the urging section may apply urging force to the body of the carriage at a plurality of positions along the scanning direction, the plurality of positions for urging the body of the carriage in the scanning direction being located on both sides of the positions where the gap adjusting cam receives the dead weight of the carriage body.

According to the ninth aspect of the invention, the urging section urges the body of the carriage on both sides of each position at which the gap adjusting cam receives the dead weight of the body of the carriage. This makes it possible to suppress rotational tilting (swinging) of the body of the carriage more effectively.

According to a tenth aspect of the invention, in the recording apparatus according to any one of the sixth to ninth aspects, the gap adjusting cam may be configured to have a stepped cam surface with alternate arrangement of flat surfaces making a thickness of the gap adjusting cam uniform in the direction where the gap changes, and inclined surfaces causing the thickness of the gap adjusting cam to vary, whereby abutment of an abutting portion provided on the slide member or the body of the carriage on the stepped cam surface defines the gap, and the recording apparatus may include a control unit that controls a motor driving the carriage, and detects in which step the gap is by detecting a drive load of the motor when the abutting portion moves on the stepped cam surface.

According to the tenth aspect of the invention, the control unit of the recording apparatus detects in which step the gap (PG) is by using a variation in the drive load of the carriage drive motor when the abutting portion is displaced. This eliminates the need for an exclusive detection unit to detect in which step the gap (PG) is, thereby ensuring cost reduction of the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of the invention will be described hereinbelow with reference to the accompanying drawings. However, the invention is not limited to the embodiment described below, and may be modified in various forms within the scope of the invention specified in the appended claims. The following description of the embodiment is given on the premise that those modifications are encompassed in the scope of the invention.

Figure 1:
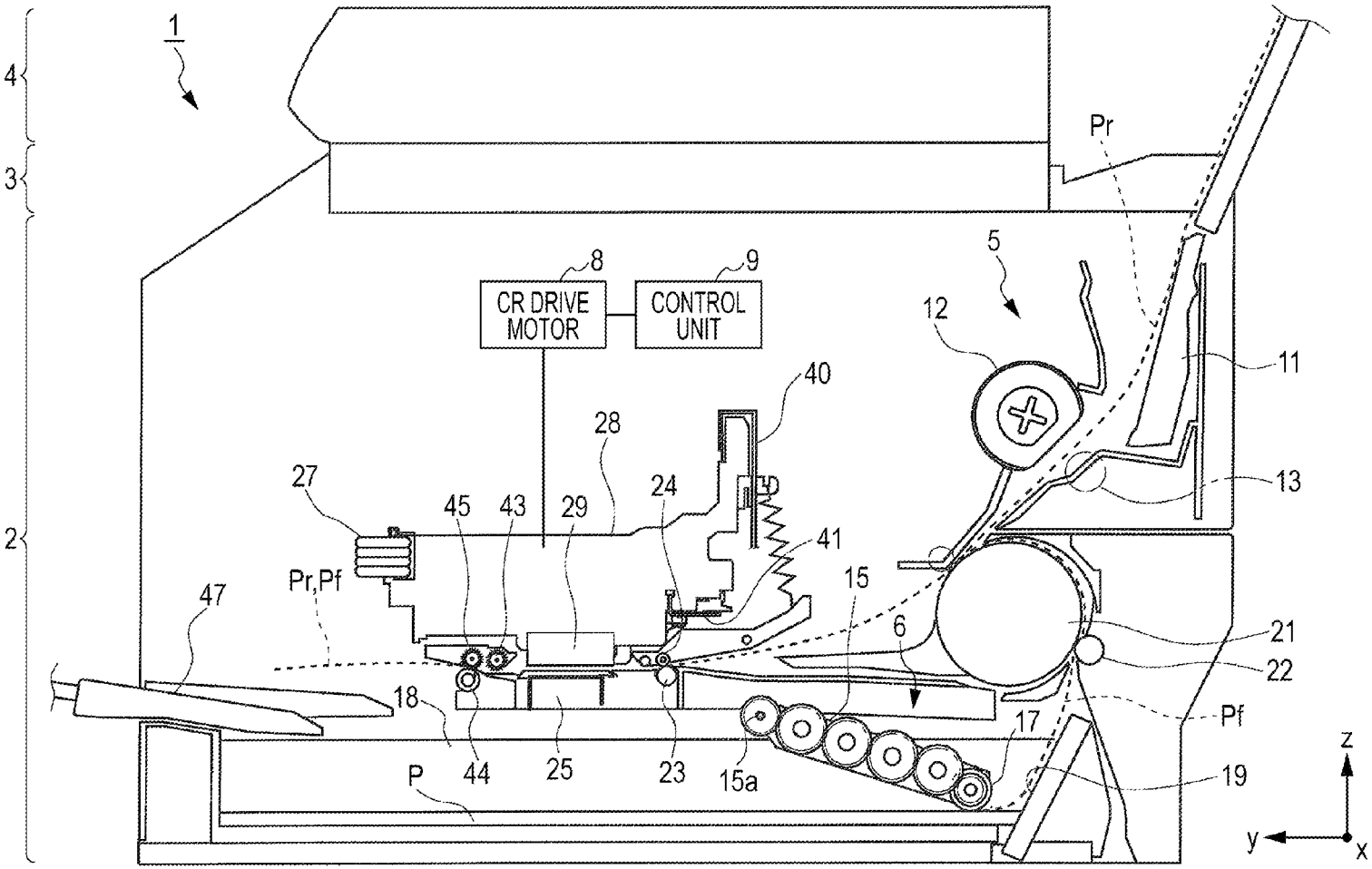
FIG. 1 is a side cross-sectional view showing a sheet transporting path for a printer according to an exemplary embodiment of the invention.
Figure 2:
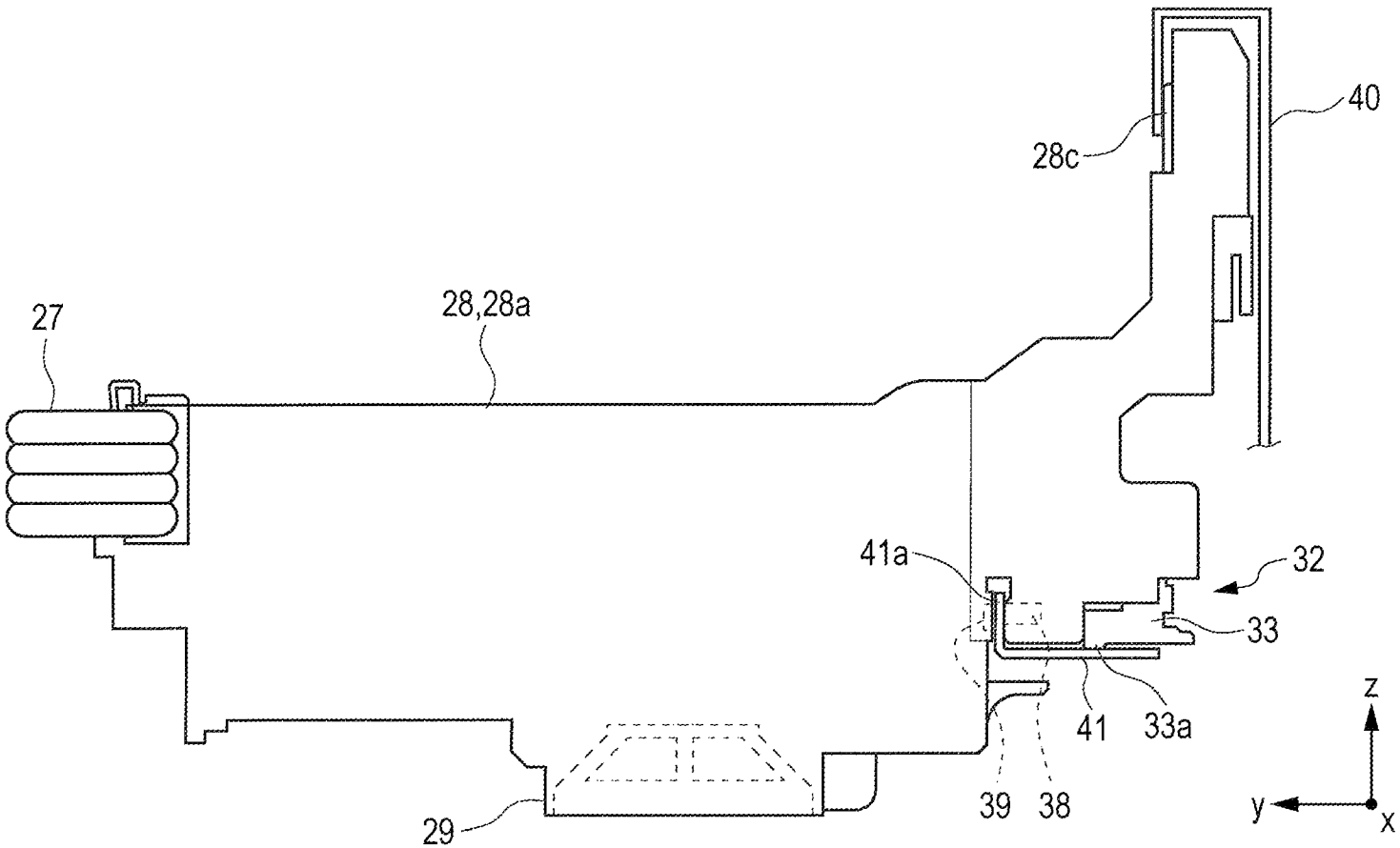
FIG. 2 is a side view of a carriage of the printer according to the embodiment of the invention.
Figure 3:
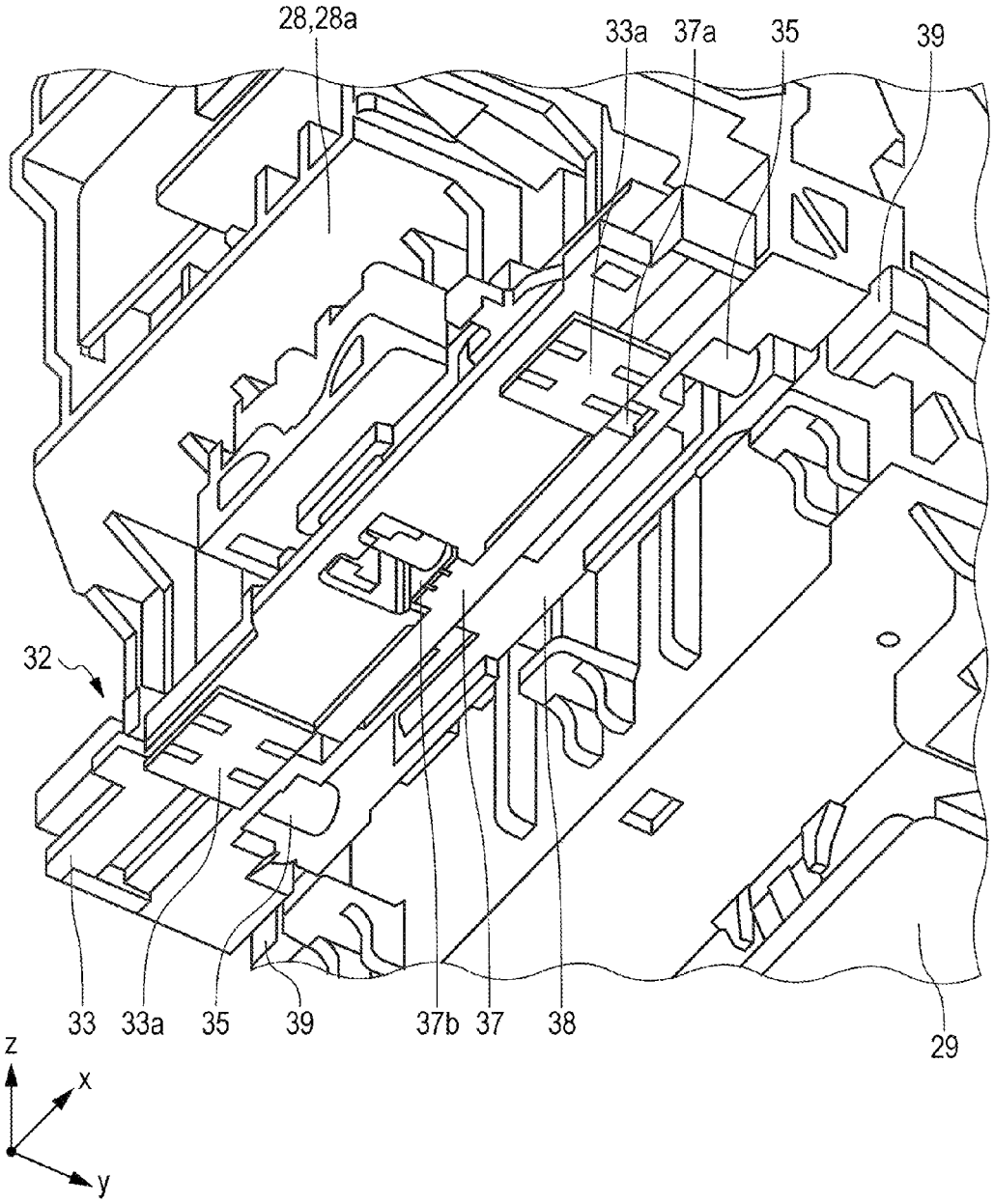
FIG. 3 is a perspective view showing the carriage of the printer according to the embodiment of the invention form the lower rear side.
Figure 4:
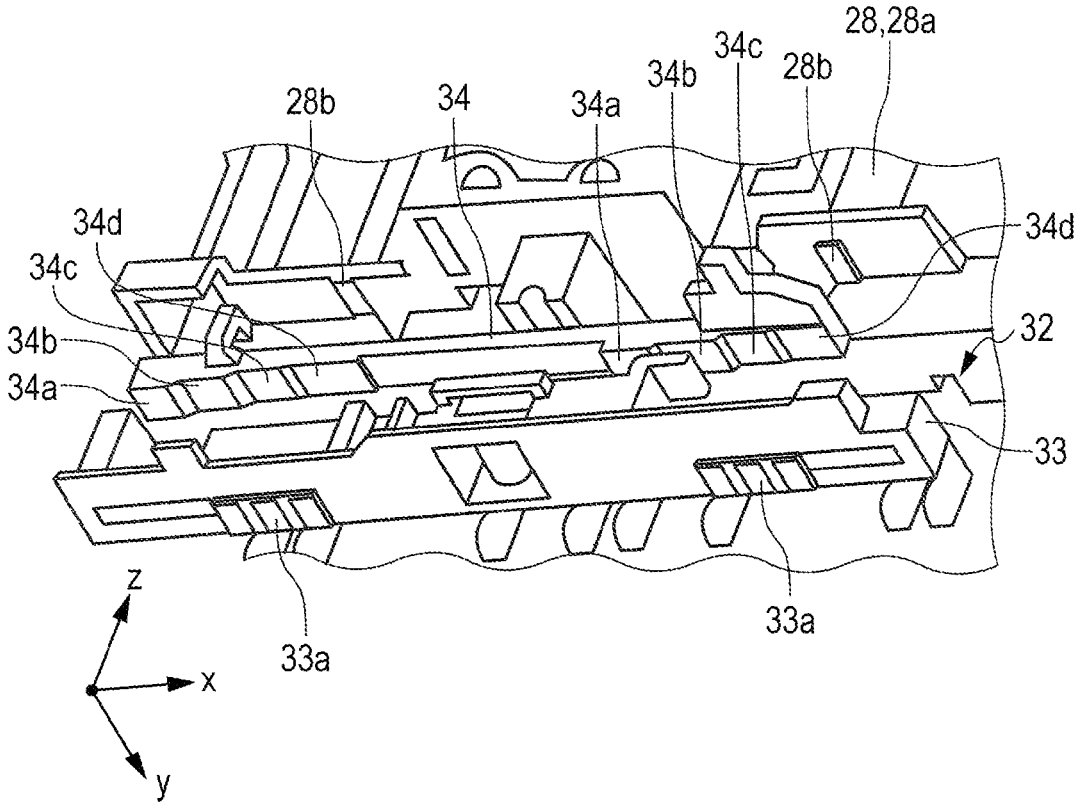
FIG. 4 is an exploded perspective view of a gap adjusting section.
Figure 5:
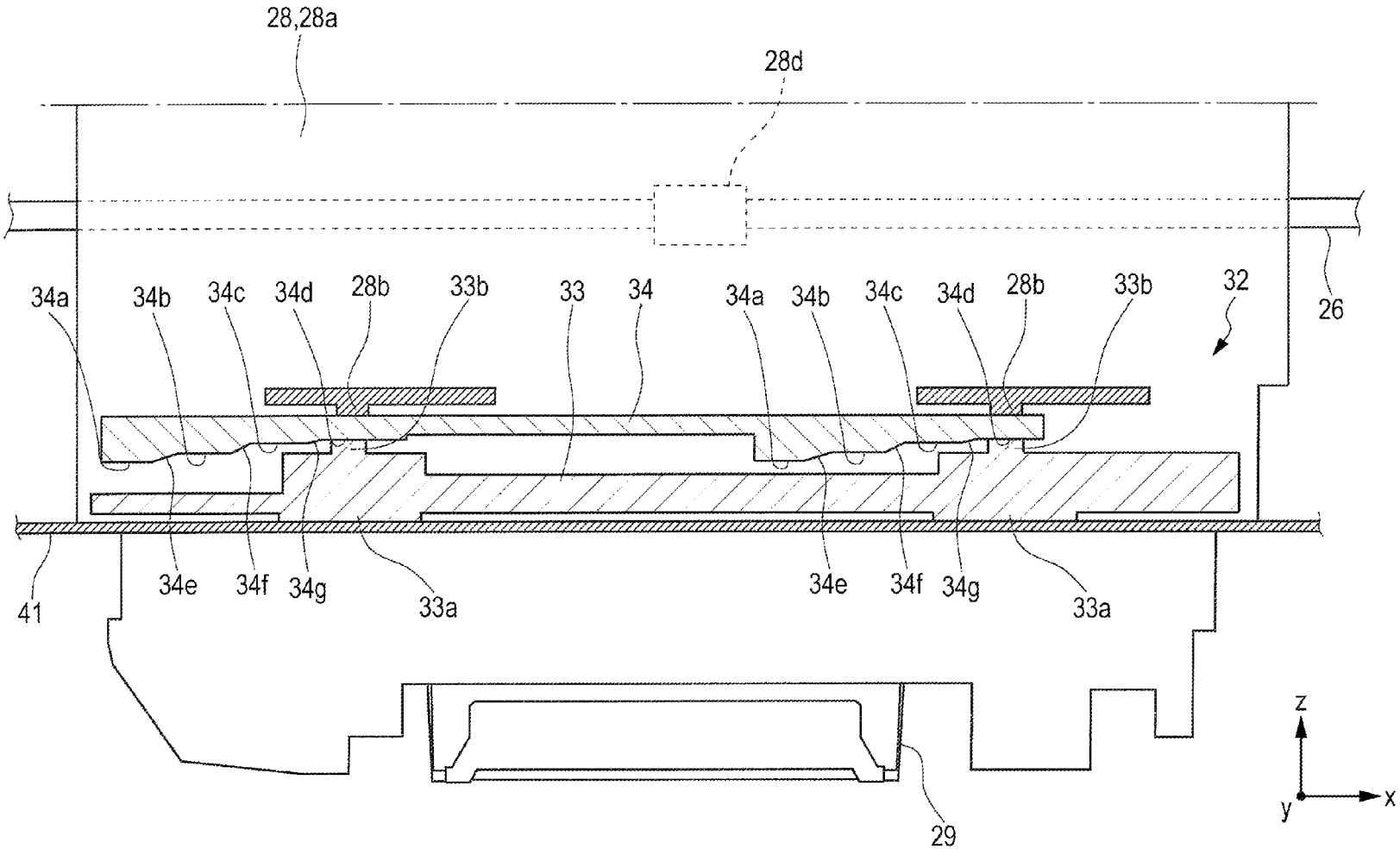
FIG. 5 is a cross-sectional view of the gap adjusting section.
Figure 6:
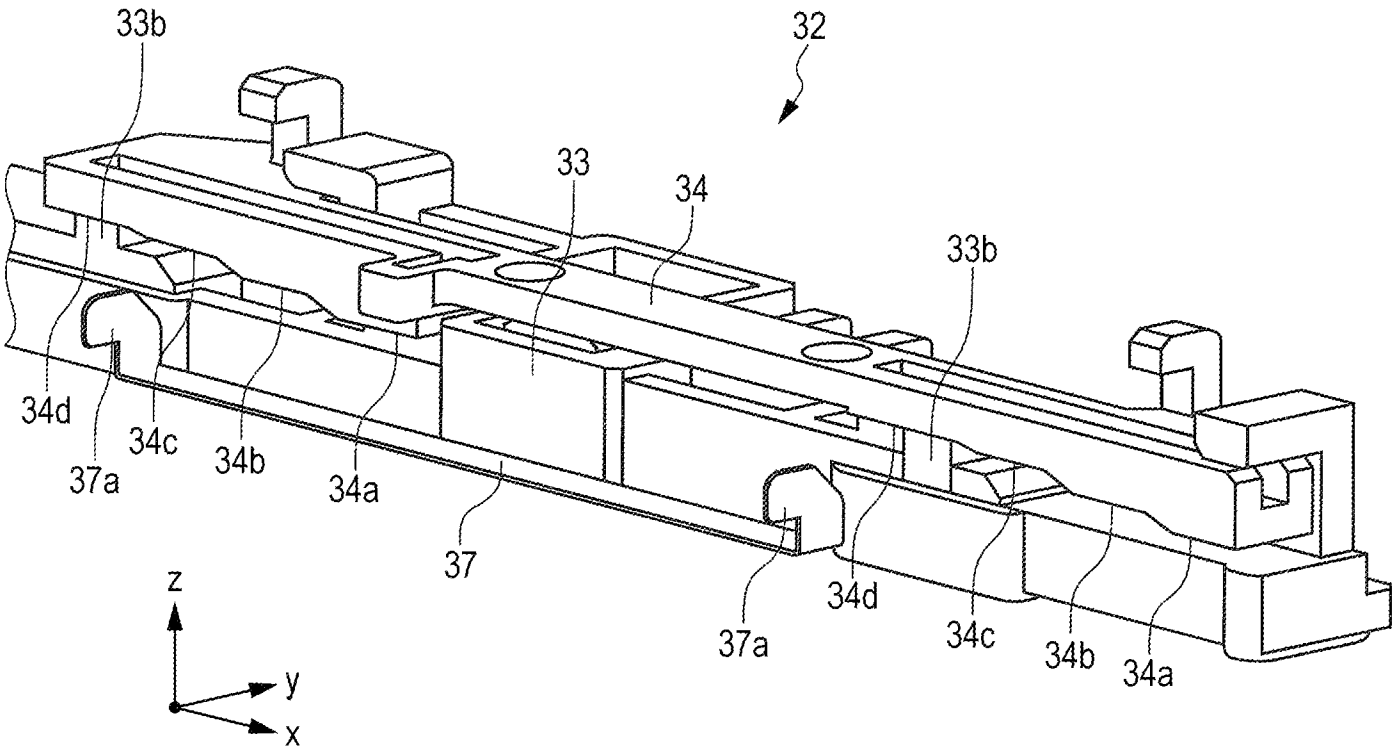
FIG. 6 is a perspective view of the gap adjusting section.
Figure 7:
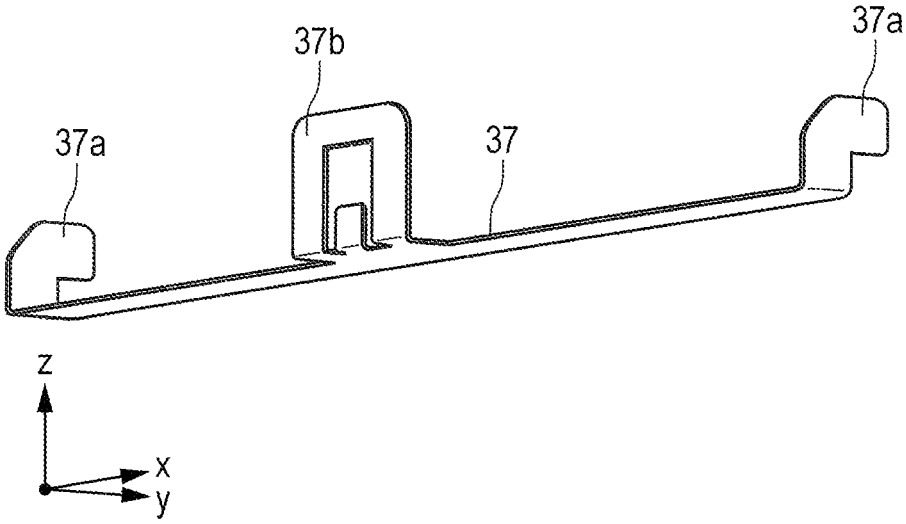
FIG. 7 is a perspective view of a plate spring (urging section).
Figure 8:
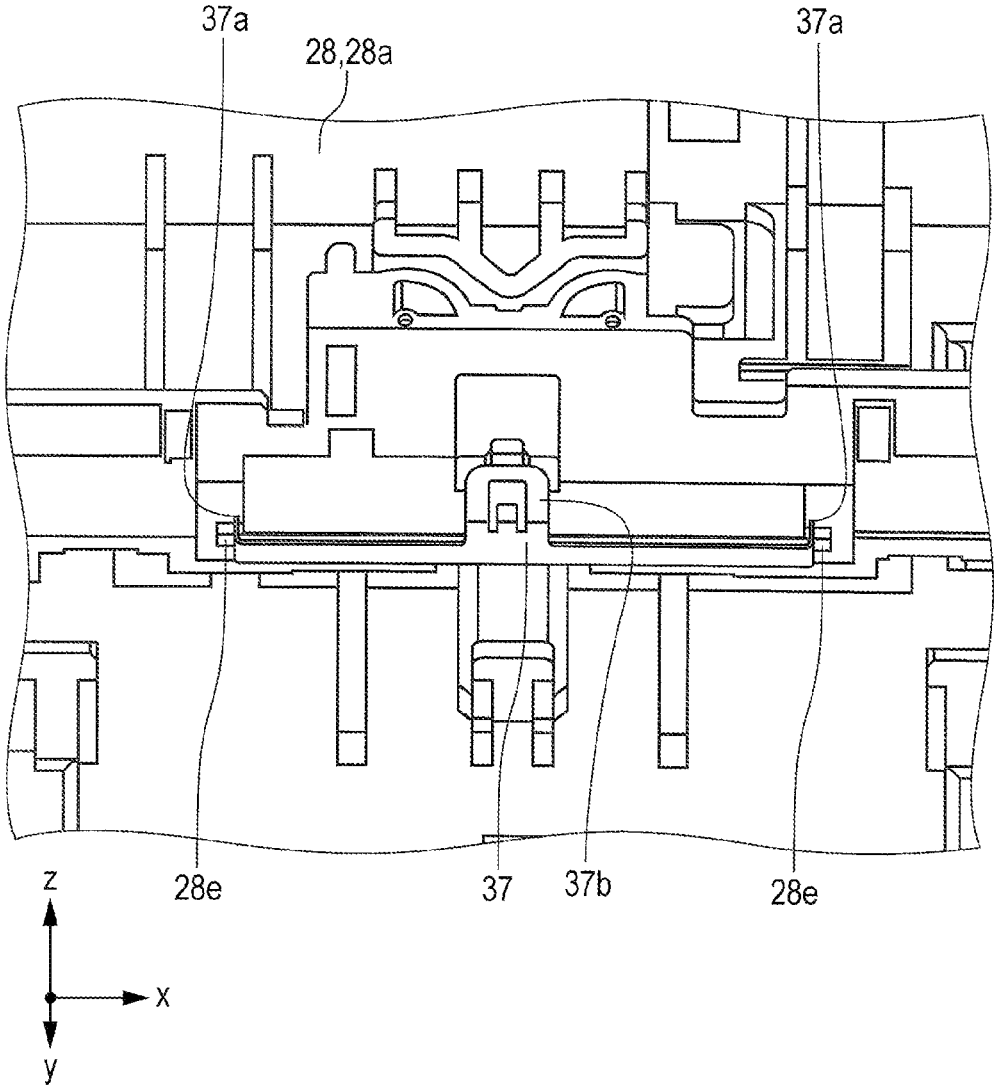
FIG. 8 is a diagram illustrating how the plate spring (urging section) engages with a carriage body.

FIG. 1 is a side cross-sectional view of an ink jet printer 1 according to the exemplary embodiment of the invention. FIG. 2 is a side view of a carriage 28, and FIG. 3 is a perspective view showing the carriage 28 form the lower rear side. FIG. 4 is an exploded perspective view of a gap adjusting section 32, FIG. 5 is a cross-sectional view of the gap adjusting section 32, and FIG. 6 is a perspective view of the gap adjusting section 32. FIG. 7 is a perspective view of a plate spring (urging section) 37, and FIG. 8 is a diagram illustrating how the plate spring (urging section) 37 engages with a carriage body 28*a*.

Figure 9A:
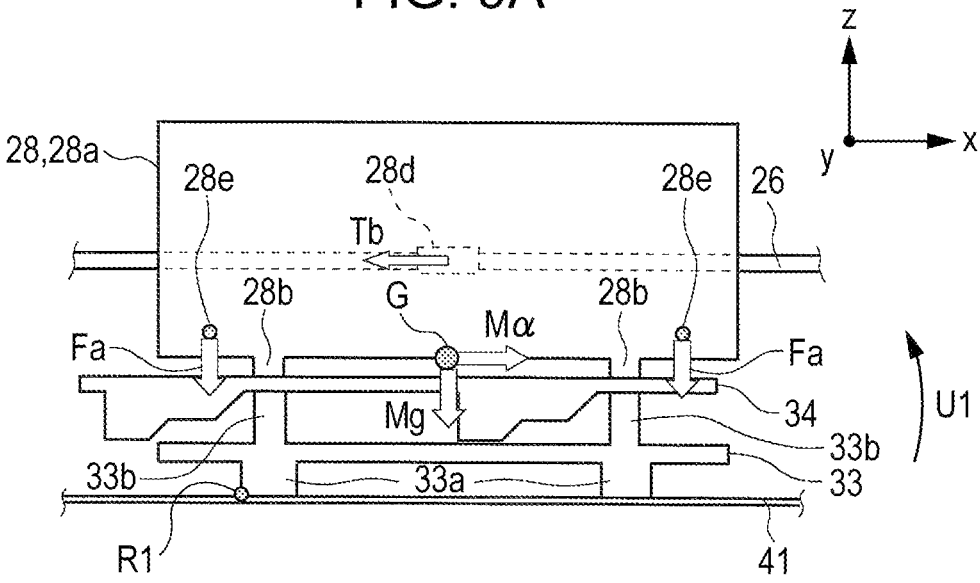
FIGS. 9A and 9B are exemplary diagrams for explaining the moving direction of the carriage body and the swinging direction of the carriage body.
Figure 9B:
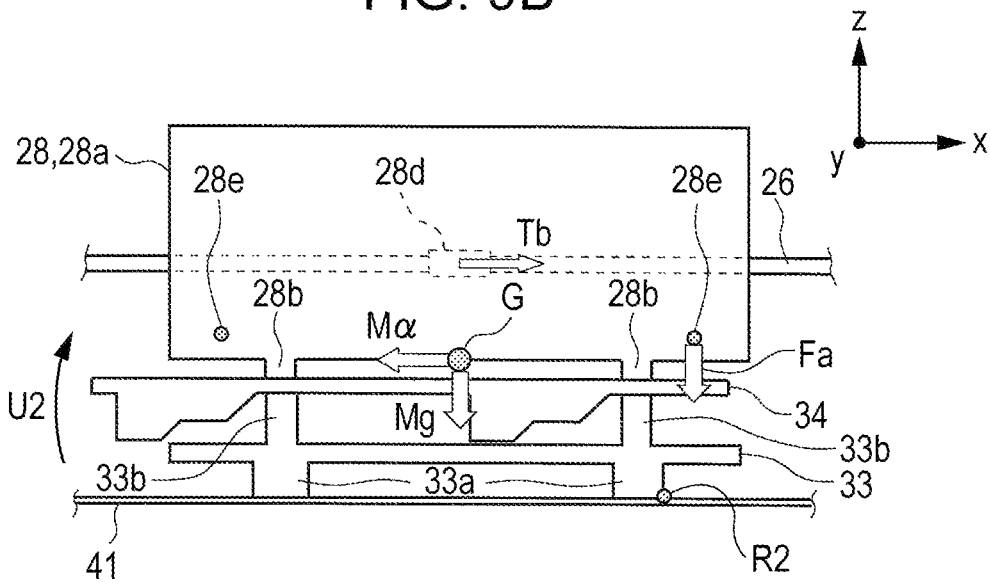
Figure 10:
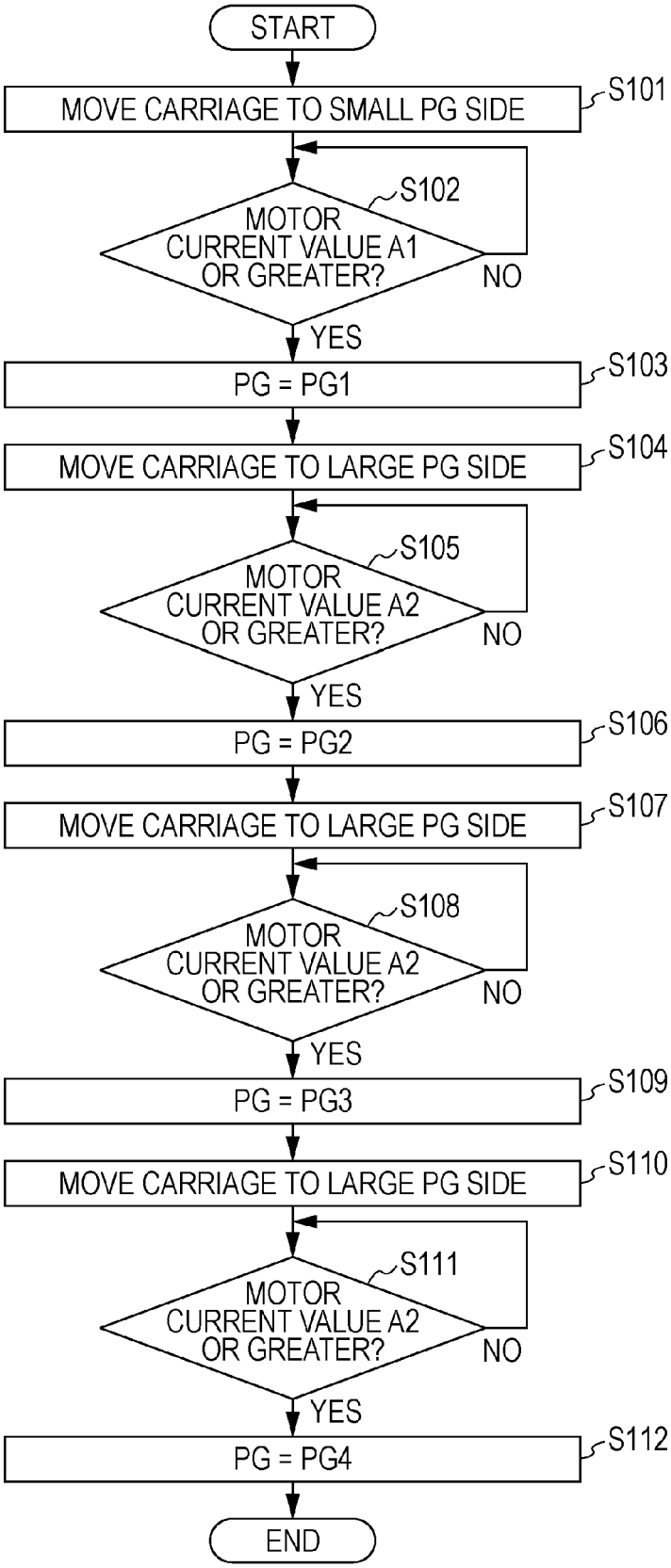
FIG. 10 is a flowchart illustrating the contents of control at the time of detecting a PG.

FIGS. 9A and 9B are exemplary diagrams for explaining the moving direction of the carriage 28 and the swinging direction of the carriage body 28*a*. FIG. 10 is a flowchart illustrating the contents of control at the time of detecting a PG. It is to be noted that the carriage body 28*a* is not shown in FIG. 6. It is to be noted also that a slider 33, a cam member 34, etc. which constitute the gap adjusting section 32 are not shown in FIG. 8.

It is to be noted that in the diagrams, an x-y-z coordinate system shows directions for the sake of descriptive convenience where the z direction is a normal direction (gravitational direction or direction orthogonal to the recording surface of a sheet), the y direction is the transporting direction of a sheet of paper P, and the x direction is a direction (main scanning direction or sheet's widthwise direction) orthogonal to the y direction and the z direction.

To begin with, the general configuration of the ink jet printer 1 will be described hereinbelow. Referring to FIG. 1, reference numeral 2 represents a recording unit that performs ink jet printing on a recording sheet as one example of a recording medium, reference numeral 3 represents an scanner unit provided at the upper portion of the recording unit 2, and reference numeral 4 represents an auto sheet transporting unit provided at the upper portion of the scanner unit 3. In other words, the ink jet printer 1 is configured as a complex machine having a scanner capability in addition to the ink jet printing capability.

Disposed at the lower part of the recording apparatus are a detachable sheet cassette 18 where sheets of recording paper are set, and a discharged-sheet recovering cassette 47 that receives discharged sheets of recording paper. The recording unit 2 has two sheet transporting paths one of which extends from a second sheet feeder 6 provided at the lower part of the recording apparatus. The other sheet transporting path extends from a first sheet feeder 5 provided at the rear side of the recording apparatus. A broken line Pf represents the sheet passing locus of recording paper fed out from the second sheet feeder 6, and a broken line Pr represents the sheet passing locus of recording paper fed out from the first sheet feeder 5.

A feed roller 17 constituting first sheet feeding unit and pivoted on a roller support member (arm member) 15 rockable about a rotary shaft 15*a* is provided in the second sheet feeder 6 at a position facing the sheet cassette 18. The feed roller 17 is provided to be movable closer to and away from the sheet cassette 18 by the rocking action of the roller support member 15. The feed roller 17 rotates, when in contact with the topmost sheet of recording paper P stored on the sheet cassette 18, to feed the topmost sheet of recording paper P downstream.

The recording paper P fed out by the feed roller 17 is flipped in a curvy form by a large-diameter inverting roller 21, and then reaches a transportation roller 23 and a transportation-driven roller 24 which serve as a transportation unit. Reference numeral 22 represents a separation roller that nips a sheet with the inverting roller 21 to separate the sheet.

In the first sheet feeder 5 provided at the upper rear portion of the recording unit 2, a sheet support member 11 supports recording paper in an inclined posture, and rocks about an overlying rocking shaft (not shown) to press the topmost one of supported sheets against a feed roller 12. The feed roller 12 rotates to feed out the pressed sheet downstream. Reference numeral 13 represents a separation roller that nips a sheet with the feed roller 12 to separate the sheet.

A transportation roller 23 and a transportation-driven roller 24 form a pair of rollers to finely feed recording paper P downstream. An ink jet recording head 29 and a support member 25 that guides a sheet downstream are disposed facing each other at the downstream of the roller pair.

The recording head 29 is provided at the bottom of the carriage 28 reciprocative in a direction (top-back-of-sheet-surface direction in FIG. 1: x direction (hereinafter referred to as "main scanning direction" or "sheet's widthwise direction")) orthogonal to the sheet transporting direction, and ejects ink on the recording paper P while moving in the main scanning direction to carry out recording. Reference numeral 8 represents a carriage (CR) drive motor 8 to drive the carriage 28, and reference numeral 9 represents a control unit that controls the CR drive motor 8.

A driven roller 43 that prevents recording paper P from being lifted, a discharge roller 44 that rotates to discharge the recording paper P, and a discharge-driven roller 45 that nips the recording paper P with the discharge roller 44 are disposed at the downstream of the recording head 29. The pair of the discharge roller 44 and the discharge-driven roller 45 allows the recording paper P where recording has been made toward the discharged-sheet recovering cassette 47.

The ink jet printer 1 is configured to be able to make recording on the back side (second side) of recording paper P by feeding the recording paper P on whose top side (first side) recording has been made back, not discharging the recording paper P to the discharged-sheet recovering cassette 47, and flipping the recording paper P in a curvy form with the inverting roller 21.

The above is the description of the schematic configuration of the ink jet printer 1, and the following will described, in detail, a gap adjusting section 32 that adjusts a gap (PG) between the recording head 29 and recording paper P, and a plate spring (urging section) 37 that suppresses swinging of the carriage 28.

Referring to FIG. 2, reference numeral 40 represents a first guide member, and reference numeral 41 represents a second guide member. The first guide member 40 and the second guide member 41 both have shapes elongated in the main scanning direction, so that when the carriage 28 moves in the main scanning direction, the carriage 28 is guided in the main scanning direction by the first guide member 40 and the second guide member 41. The first guide member 40 and the second guide member 41 are formed of a metal according to the embodiment.

More specifically, a slide portion 28*c* is provided on the upper portion of the carriage 28, and slides in contact with the first guide member 40. A slider 33 as a "slide member" provided on the carriage 28 slides in contact with the top surface of the second guide member 41. The first guide member 40 exclusively serves to stop the counterclockwise rotation of the carriage 28 in FIG. 2, and the second guide member 41 exclusively serves to receive the dead weight of the carriage 28.

The carriage body 28*a* of the carriage 28 is displaced in the up-down direction (z direction) while the state of contact of the slide portion 28*c* with the first guide member 40 and the state of contact of the slider 33 with the second guide member 41 are maintained by the gap adjusting section 32, thereby ensuring adjustment of the PG.

That is, the gap adjusting section 32 adjusts the PG by adjusting the position of the carriage body 28*a* relative to the slider 33 (first slide portions 33*a*). It is to be noted that the first guide member 40 and the second guide member 41 are provided fixedly, and are not displaced according to the embodiment.

In FIGS. 3, 4 and 5, the gap adjusting section 32 is configured to include the slider 33 as the "slide member", and the cam member 34 as a "gap adjusting cam".

The slider 33 and the cam member 34 both move in the main scanning direction together with the carriage 28. The cam member 34 is provided on the carriage body 28*a* in such a way as to be displaceable in the main scanning direction relative to the carriage body 28*a* and the slider 33. The displacement of the cam member 34 in the main scanning direction changes the PG.

More specifically, abutting portions 28*b* are integrally provided on the carriage body 28*a*, and are mounted on the top surface of the cam member 34. That is, the dead weight of the carriage 28 is applied to the cam member 34 via the abutting portions 28*b*.

The cam member 34 has its bottom surface formed as a stepped cam surface formed by a first abutting portion 34*a*, a second abutting portion 34*b*, a third abutting portion 34*c* and a fourth abutting portion 34*d*. Those abutting portions 34*a* to 34*d* are supported by support sections 33*b* formed on the top side of the slider 33. The abutting portions 34*a* to 34*d* are connected by smooth inclined surfaces (represented by reference numerals 34*e*, 34*f* and 34*g*), so that the cam member 34 can move in the main scanning direction without getting stuck.

The first slide portions 33*a* are formed on the bottom side of the slider 33. The first slide portions 33*a* slide in contact with the top surface of the second guide member 41 when the carriage 28 moves. The second guide member 41 is formed in an L shape as shown in FIG. 2. The y-directional position of the carriage 28 is set by holding a bent portion 41*a* extending upward with a movable slider 38 and a fixed slider 39 which are provided on the carriage body 28*a* (see FIG. 3 in which the second guide member 41 is not shown). Reference numeral 35 represents a coil spring that urges the movable slider 38 toward the fixed slider 39.

Referring to FIG. 5, reference numeral 26 represents an endless belt which pulls the carriage 28 in the main scanning direction. The endless belt 26 is put around a drive pulley and a driven pulley (neither shown), so that when the drive pulley is driven by a motor (not shown), the endless belt 26 runs to move the carriage 28 in the main scanning direction. Reference numeral 28*d* indicates a position (to-be-pulled portion) of the carriage body 28*a* where the endless belt 26 is fixed.

With the foregoing configuration, as described above, the cam member 34 is provided on the carriage body 28*a* in such a way as to be displaceable in the main relative to the carriage body 28*a* and the slider 33.

Further, the slider 33 is provided on the carriage body 28*a* in such a way as to be movable relative to the PG adjusting direction (z direction) while moving together with the carriage body 28*a* in the main scanning direction. In other words, the carriage body 28*a* can be displaced in the PG adjusting direction relative to the slider 33.

The thickness of the cam member 34 becomes larger in the order of the fourth abutting portion 34*d*, the third abutting portion 34*c*, the second abutting portion 34*b* and the first abutting portion 34*a*. When the cam member 34 is displaced rightward from the position in FIG. 5 (where the PG is the smallest) and the abutting portion which is in abutment on the support section 33*b* of the slider 33 changes from the fourth abutting portion 34*d*, to the third abutting portion 34*c*, the second abutting portion 34*b*, then the first abutting portion 34*a*, the PG increases stepwisely. When the cam member 34 moves leftward in FIG. 5 from the state where the PG is the largest, contrary to the above case, the PG decreases stepwisely.

The slide action of the cam member 34 is achieved by an unillustrated engagement portion and the carriage movement. That is, the engagement portion (not shown) is provided in such a way as to be displaceable between a position in which the engagement portion is engageable with the cam member 34 and a position in which the engagement portion does not engage with the cam member 34 in the reciprocal path of the carriage 28. As the carriage 28 moves when the engagement portion (not shown) is in the position where the engagement portion is engageable with the cam member 34, the cam member 34 engages with the engagement portion (not shown). When the carriage 28 moves further, the cam member 34 slides relative to the carriage body 28*a* and the slider 33.

The slide action of the cam member 34 is achieved by the movement of the carriage 28 with the cam member 34 restrained in the main scanning direction by the engagement portion (not shown), so that it is not the cam member 34 but the carriage body 28*a* and the slider 33 that are actually displaced in the main scanning direction at the time the PG is changed.

The control unit 9 of the ink jet printer 1 detects in which step the PG is at present (on which one of the first to fourth abutting portions 34*a* to 34*d* the support section 33*b* of the slider 33 is abutting) based on an increase in the value of the current of the CR drive motor 8, the moving direction of the carriage 28, the amount of movement of the carriage 28.

That is, based on an increase in the value of the current of the CR drive motor 8, it is possible to determine changing of the PG, and it is also possible to determine that the PG is the smallest or the largest. In addition, it is possible to determine whether the PG changes on a larger side or a smaller side based on the carriage moving direction. Further, the amount of carriage movement can be detected by a component (e.g., linear encoder (not shown)) that detects the amount of movement of the carriage 28.

The control unit 9 of the ink jet printer 1 can also grasp in which step the PG is at present without using the component (e.g., linear encoder (not shown)) that detects the amount of carriage movement. This detection can be specifically achieved based on the following facts. Each of the abutting portions (34*a* to 34*d*) constituting the stepped cam surface of the cam member 34 has a constant thickness within the area of the abutting portion, and the drive load (current value) of the CR drive motor 8 does not show a significant change when the support section 33*b* of the slider 33 slides within each abutting portion. When the support section 33*b* moves on the inclined surface (34*e*, 34*f*, 34*g*) held between the individual abutting portions, however, the drive load (current value) of the CR drive motor 8 changes significantly.

FIG. 10 illustrates one example of the method of achieving the detection. First, the carriage 28 is moved to a small PG side (PG1 side) until the drive current value of the CR drive motor 8 becomes A1 or greater (steps S101 and S102). That is, the slidable range of the cam member 34 is restricted to the range of PG1 to PG4 by a restriction section (not shown), and the carriage 28 is moved until the cam member 34 reaches the restriction section.

PG1 is the PG when the support section 33*b* contacts the fourth abutting portion 34*d*, PG2 is the PG when the support section 33*b* contacts the third abutting portion 34*c*, PG3 is the PG when the support section 33*b* contacts the second abutting portion 34*b*, and PG4 is the PG when the support section 33*b* contacts the first abutting portion 34*a*.

When Yes in step S102, it can be determined that PG=PG1 (step S103). Next, the carriage 28 is moved to a large PG side (PG2 side) until the drive current value of the CR drive motor 8 becomes A2 or greater (steps S104 and S105). That is, it is detected that the support section 33*b* passes through the inclined surface 34*g*.

When Yes in step S105, it can be determined that PG=PG2 (step S106). The current value A2 (step S105, S108, S111) is smaller than the current value A1 (step S102). Thereafter, PG3 and PG4 can be detected similarly (steps S107 to S112).

Subsequently, the plate spring 37 as the urging section will be described. As mentioned above, the cam member 34 is mounted on the slider 33 by the dead weight of the carriage body 28*a*, and the abutting portions 28*b* of the carriage 28 are mounted on the cam member 34 by the dead weight of the carriage body 28*a*.

According to the configuration, the plate spring 37 shown in FIG. 3 and FIGS. 6 to 8 is provided in such a way as to serve as the urging section that exerts urging force between the slider 33 and the carriage body 28*a* in a direction of pulling the slider 33 and the carriage body 28*a*. In other words, the plate spring 37 is provided in such a way as to pinch the cam member 34 between the abutting portions 28*b* of the carriage 28 and the slider 33.

The plate spring 37 has a shape extending in the x direction when mounted, and has a hook portion 37*a* formed at each end, and a mount portion 37*b* in the center portion. The plate spring 37 is mounted on the slider 33 via the mount portion 37*b* in such a way as not to rotate on an x-z plane. With the slider 33 provided on the carriage body 28*a*, the hook portions 37*a* formed at both ends of the plate spring 37 engage with to-be-engaged portions 28*e* (FIG. 8) formed on the carriage body 28*a*, respectively. Accordingly, the plate spring 37 exerts urging force between the slider 33 and the carriage body 28*a* in the direction of pulling the slider 33 and the carriage body 28*a*.

The action of the plate spring 37 will be described below referring to FIGS. 9A and 9B. FIG. 9A shows a case where the carriage 28 is pulled leftward in the diagram at which time the carriage body 28*a* tends to rotate (swing) about a position R1. In FIG. 9A, reference numeral M represents the dead weight of the carriage 28, reference numeral $\alpha$ represents the acceleration in the carriage moving direction, reference numeral g represents the gravitational acceleration, and reference numeral Tb represents the traction force of the endless belt 26. Reference numeral G represents the center of gravity of the carriage 28.

When the carriage 28 starts moving leftward in FIG. 9A from the resting state, as shown in FIG. 9A, the force Tb causes the carriage 28 to rotate counterclockwise in the diagram, forces M$\alpha$ and Mg act to cancel the force Tb. When the force Tb wins the forces M$\alpha$ and Mg, the carriage 28 tends to rotate counterclockwise in FIG. 9A as indicated by an arrow U1. That is, the abutting portions 28*b* (carriage body 28*a*) tend to lift up (swing) from the cam member 34, or the cam member 34 tends to lift up (swing) from the support sections 33*b* (slider 33).

Because the state of the cam member 34 held by the abutting portions 28*b* (carriage body 28*a*) and the support sections 33*b* (slider 33) is firmly maintained by the urging force of the plate spring 37, however, this state becomes resistance force against a rotational moment U1 to suppress the aforementioned swinging, thereby providing favorable recording results.

When the carriage 28 moves rightward in FIG. 9B, as shown in FIG. 9B, the carriage 28 likewise tends to rotate about a position R2 as indicated by an arrow U2. However, the state of the cam member 34 held by the abutting portions 28*b* (carriage body 28*a*) and the support sections 33*b* (slider 33) is firmly maintained by the urging force of the plate spring 37. Therefore, this state becomes resistance force against a rotational moment U2 to suppress the aforementioned swinging, thereby providing favorable recording results.

The urging force of the plate spring 37 changes with a change in PG. Specifically, the hook portions 37*a* of the plate spring 37 are engaged with the to-be-engaged portions 28*e* of the carriage body 28*a* which moves up and down by adjustment of the PG, and the mount portion 37*b* of the plate spring 37 is mounted on the slider 33 which is not displaced in the PG adjusting direction, so that when the PG becomes larger, the urging force of the plate spring 37 becomes stronger.

When the PG becomes larger, the rotational moment U1, U2 becomes larger too, but the urging force of the plate spring 37 becomes larger too, changing the PG so that swinging of the carriage 28 can be suppressed adequately according to the amount of the change in PG.

Another effect of the action of the plate spring 37 according to the embodiment is prevention of enlargement of the recording apparatus. To further suppress the swinging of the carriage 28, it is necessary to make the x-directional length of the cam member 34 larger to secure the distance between the two abutting portions 28*b* and the distance between the two support sections 33*b*. Since the state of the cam member 34 held by the abutting portions 28*b* (carriage body 28*a*) and the support sections 33*b* (slider 33) is firmly maintained by the urging force of the plate spring 37, however, a large x-directional length of the cam member 34 need not be secured, thereby avoiding enlargement of the recording apparatus.

Further, the state of contact between each of the abutting portions (34*a* to 34*d*) of the cam member 34 and each support section 33*b* becomes stable, so that reproducibility of changing the PG can be secured (prevention of a variation in PG at the same step). In addition, because the assembled state is firmly maintained even when impact of dropping or the like is applied to the recording apparatus, it is possible to prevent the PG from being changed unintentionally.

According to the embodiment, the cam member 34 receive the dead weight of the carriage body 28*a* at a plurality of locations in the x direction, the plate spring 37 applies urging force to the carriage body 28*a* at a plurality of locations along the x direction, and the positions (to-be-engaged portions 28*e*, 28*e*) at which the plate spring 37 urges the carriage body 28*a* are located on both sides of the positions (abutting portions 28*b*, 28*b*) where the cam member 34 receives the dead weight of the carriage body 28*a*. This makes it possible to suppress the swinging of the carriage 28 more effectively.

According to the embodiment, the state of the cam member 34 held by the abutting portions 28*b* (carriage body 28*a*) and the support sections 33*b* (slider 33) is firmly maintained by the plate spring 37. However, the means of maintaining the firm state is not limited to the plate spring 37, and may be achieved by any other means which can firmly maintain the state of the cam member 34 held by the abutting portions 28*b* (carriage body 28*a*) and the support sections 33*b* (slider 33).

Therefore, a pinching section that pinches the cam member 34 between the slider 33 and the carriage body 28*a* (to-be-engaged portions 28*e*, 28*e*) may be usable. The plate spring 37 is an example of such a pinching section. Another available means is a restriction section that restricts expansion between the abutting portions 28*b* (carriage body 28*a*) and the cam member 34, or expansion between the cam member 34 and the support sections 33*b* (slider 33). The plate spring 37 is also an example of such a restriction section.

According to the embodiment, arrangement of the abutting portion 28*b*, the support section 33*b*, the first slide portion 33*a* at the same position on the x-y plane can prevent deformation of, particularly, the cam member 34 and the slider 33.

The entire disclosure of Japanese Patent Application No. 2011-204446, filed Sep. 20, 2011 is expressly incorporated by reference herein.

The entire disclosure of Japanese Patent Application No. 2011-204446, filed Sep. 20, 2011 is expressly incorporated by reference herein.

What is claimed is:

1. A recording apparatus comprising:

a recording head that performs recording on a medium; and a carriage movable in a scanning direction of the recording head, the carriage including a carriage body holding the recording head, a slide member that is provided in such a way that a position of the slide member relative to the carriage body is changeable in a direction where a gap between the recording head and the medium changes, and moves together with carriage body in the scanning direction, a gap adjusting cam that is interposed between the slide member and the carriage body to receive a dead weight of the carriage body, the gap adjusting cam having a surface profile that changes in the scanning direction, the gap adjusting cam being movable relative to the slide member and the carriage body to change the gap between the recording head and the medium, and a restriction section having a shape extending in the scanning direction, the restriction section is configured to restrict expansion between the carriage body and the gap adjusting cam or expansion between the gap adjusting cam and the slide member, the restriction section is configured to engage with the carriage body at both end portions, is attached to the slide member at a center portion, and is configured to apply an urging force between the slide member and the carriage body based upon changes with the gap.

2. The recording apparatus according to claim 1, wherein the surface profile of the gap adjusting cam is a stepped cam surface with alternate arrangement of flat surfaces, and inclined surfaces, whereby abutment of an abutting portion provided on the slide member or the carriage body on the stepped cam surface defines the gap, and the recording apparatus includes a control unit that controls a motor driving the carriage, and detects in which step the gap is by detecting a drive load of the motor when the abutting portion moves on the stepped cam surface.

3. The recording apparatus according to claim 1, wherein the gap adjusting cam receives the dead weight of the carriage body at a plurality of positions in the scanning direction, and the restriction section restricts the carriage body at a plurality of positions along the scanning direction, the plurality of positions for restricting the carriage body in the scanning direction being located on both sides of the positions where the gap adjusting cam receives the dead weight of the carriage body.

4. A recording apparatus comprising:

a recording head that performs recording on a medium; and a carriage movable in a scanning direction of the recording head, the carriage including a carriage body holding the recording head, a slide member that is provided in such a way that a position of the slide member relative to the carriage body is changeable in a direction where a gap between the recording head and the medium changes, and moves together with carriage body in the scanning direction, a gap adjusting cam that is interposed between the slide member and the carriage body and is configured to receive a dead weight of the carriage body at a plurality of positions in the scanning direction, the gap adjusting cam having a surface profile that changes in the scanning direction, the gap adjusting cam being movable relative to the slide member and the carriage body to change the gap between the recording head and the medium, and a restriction section configured to restrict expansion between the carriage body and the gap adjusting cam or expansion between the gap adjusting cam and the slide member, the restriction section restricts the carriage body at a plurality of positions along the scanning direction, the plurality of positions for restricting the carriage body in the scanning direction being located on both sides of the positions where the gap adjusting cam receives the dead weight of the carriage body.

5. The recording apparatus according to claim 4, wherein the restriction section has a shape extending in the scanning direction, with a thickness changing along a length of the restriction section in the scanning direction, the changing thickness correspond with changes to the gap.

6. The recording apparatus according to claim 4, wherein the gap adjusting cam is configured to have a stepped cam surface with alternate arrangement of flat surfaces defining changes in the gap and inclined surfaces disposed between at least two of the alternate arrangement of flat surfaces, whereby abutment of an abutting portion provided on the slide member or the carriage body on the stepped cam surface defines the gap, and the recording apparatus includes a control unit that controls a motor driving the carriage, and detects in which step the gap is by detecting a drive load of the motor when the abutting portion moves on the stepped cam surface.

7. The recording apparatus according to claim 5, wherein the restriction section is configured to engage with the carriage body at both end portions, and is configured to attach to the slide member at a center portion.

8. The recording apparatus according to claim 7, wherein the gap adjusting cam receives the dead weight of the carriage body at a plurality of positions in the scanning direction, and the restriction section restricts the carriage body at a plurality of positions along the scanning direction, the plurality of positions for restricting the carriage body in the scanning direction being located on both sides of the positions where the gap adjusting cam receives the dead weight of the carriage body.

9. A recording apparatus comprising:

a recording head that performs recording on a medium; and a carriage movable in a scanning direction of the recording head, the carriage including a carriage body holding the recording head, a slide member that is provided in such a way that a position of the slide member relative to the carriage body is changeable in a direction where a gap between the recording head and the medium changes, and moves together with carriage body in the scanning direction, a gap adjusting cam that is interposed between the slide member and the carriage body and is configured to receive a dead weight of the carriage, the gap adjusting cam having a surface profile that changes in the scanning direction, the gap adjusting cam being movable relative to the slide member and the carriage body to change the gap between the recording head and the medium, and a restriction section that is configured to restrict expansion between the carriage body and the gap adjusting cam or expansion between the gap adjusting cam and the slide member, the restriction section is configured to apply an urging force between the slide member and the carriage body based upon changes with the gap, wherein when the gap becomes larger, the urging force becomes stronger.

* * * * *